United States Patent [19]

DeHart et al.

[11] 4,113,105

[45] Sep. 12, 1978

[54] DEVICE FOR CHECKING ENVELOPES FOR ENCLOSED DOCUMENTS

[75] Inventors: John R. DeHart, Coral Gables, Fla.; Larry L. Nelson, Redwood City, Calif.; William H. Krehl, Homestead, Fla.

[73] Assignee: Docutronix, Inc., Homestead, Fla.

[21] Appl. No.: 775,386

[22] Filed: Mar. 7, 1977

[51] Int. Cl.[2] ..... B07C 5/344

[52] U.S. Cl. ..... 209/549; 209/588; 250/223 R

[58] Field of Search ..... 209/73, 74, 111.7 T, 209/DIG. 1, 111.7 R; 250/222 R, 223 R, 224

[56] References Cited

U.S. PATENT DOCUMENTS 4,016,980 4/1977 DeHart ..... 209/111.7 T

*Primary Examiner*—Allen N. Knowles

*Attorney, Agent, or Firm*—McCormick, Paulding & Huber

[57] ABSTRACT

A device for checking supposedly emptied envelopes for documents, as the envelopes are fed in spaced end-to-end relationship past an inspection station, consists of three sensors at the inspection station arranged along a line perpendicular to the envelope path to sense the opacity of each envelope along three zones located respectively near the top, near the bottom and near the center of the envelope. The output of the center sensor serves as a reference for the top and bottom sensors and a signal processing circuit connected with the sensors produces a suspect signal, indicating the suspected presence of a document in an envelope, when the output of either the top or bottom sensor compares unfavorably with that of the center sensor for an amount of time sufficient to make the device insensitive to short duration opacity differences caused by overlapping envelope seams. Since the center sensor provides a reference signal for each individual envelope, the device is insensitive to changes in opacity from envelope to envelope due to differences in the papers from which the envelopes are made. Further, the output of the center sensor is also compared with a predetermined reference signal to detect unusually wide documents which intercept the sensing fields of all three sensors. A gate mechanism operable in response to the production or non-production of a suspect signal as each envelope passes the inspection station segregates envelopes suspected of containing documents from those not so suspected.

12 Claims, 5 Drawing Figures

DEVICE FOR CHECKING ENVELOPES FOR ENCLOSED DOCUMENTS

BACKGROUND OF THE INVENTION

This invention relates to envelope handling equipment and deals more particularly with such equipment for checking a plurality of envelopes for the presence of enclosed documents.

The device of this invention is somewhat similar in function to that of U.S. Pat. No. 4,016,980, filed May 9, 1975 and entitled DEVICE FOR CHECKING ENVELOPES FOR ENCLOSED DOCUMENTS, and is an improvement on the device disclosed therein.

As is also the case with the device described in the above-mentioned application, the device of this invention may be used in various different applications where it is necessary or desirable to inspect a large number of envelopes for the presence of enclosed documents and to segregate those suspected, as a result of the inspection, of containing documents. For example, many businesses, government agencies and other institutions have mail receiving or similar departments to which documents such as checks, bills, order forms, receipts and the like are delivered in sealed delivery or mailing envelopes. After receipt of the envelopes, they are opened and their contents extracted, and after such extraction they are normally considered waster and are suitably disposed of. The envelope opening and content extracting processes may be carried out either by hand or through the use of automatic machinery; but, in either case, it is possible that some mistakes may be made causing some forwarded documents to be unextracted from their envelopes and to be accordingly consigned to waste with the envelopes and destroyed. The device of this invention is particularly useful in this situation for checking previously opened and supposedly emptied envelopes and for retrieving those suspected of containing enclosed documents prior to their destruction.

Usually the envelopes involved are return mail envelopes provided by the addressee and are, therefore, all of similar size facilitating their handling by automated equipment. However, the envelopes may originate from various different manufacturers, or single manufacturers, using different paper stocks of highly different opacities. Therefore, the detection of enclosed documents by opacity sensing is complicated by the fact that the envelopes themselves may be of quite different opacity from envelope to envelope. The device of this invention is especially insensitive to such envelope opacity differences and, therefore, is particularly well adapted for use in those situations where such differences exist and are otherwise a problem.

The device of this invention makes use of the fact that a document enclosed in an envelope is normally substantially smaller in width than the envelope so that as a document containing envelope passes the inspection station either the top or bottom sensor, or both, will see a lesser opacity than the center sensor, and this difference is used to produce a suspect signal. In rare instances, however, the enclosed document may be of such width as to intercept all three opacity sensors when its envelope passes the inspection station. To provide for this contingency, the device of the invention also includes a means for producing a suspect signal in the event the opacity sensed by the center sensor exceeds a predetermined level for a predetermined time, thereby further augmenting the reliability of the device and making its error rate extremely small.

Other objects and advantages of the invention will be apparent from the following description and from the drawings forming a part hereof.

SUMMARY OF THE INVENTION

The invention resides in a device which operates as follows to check a plurality of generally rectangular envelopes, usually return mail envelopes provided by the addressee, which have been previously opened and supposedly emptied, for enclosed documents. The envelopes are fed one at a time in spaced end-to-end relationship past an inspection station having three opacity sensors arranged along a line perpendicular to the path of envelope travel to sense the opacity of each envelope along three longitudinally extending zones as it passes the station. One zone is located slightly inboard of one side edge, another zone is located slightly inboard of the other side edge, and the third zone is located substantially in the center of the envelope. The output of the center sensor serves as a reference for the outputs of the other two sensors and is compared with each of said other outputs. If either comparison is unfavorable (that is, the signal from the center sensor indicates a greater opacity than that from the sensor with which it is being compared) a non-compare signal of fixed voltage is produced. This non-compare signal is integrated and if it reaches a predetermined value, which requires a predetermined time, a suspect signal is produced and stored in a register. The output of one of the opacity sensors also provides leading edge and trailing edge signals as leading edges of envelopes enter the inspection station and as trailing edges of envelopes leave the inspection station. If upon the occurrence of a trailing edge signal the suspect signal register contains a suspect signal, a gate mechanism is activated to divert the envelope creating such signal to a suspect destination. If no suspect signal is in the register at the occurrence of a trailing edge signal, the gate mechanism remains unactivated and directs the associated envelope to a waste destination.

The invention further resides in the output of the center sensor also being compared with a predetermined manually adjustable reference signal and to the signal processing circuit also serving to produce a suspect signal in the event the signal from the center sensor compares unfavorably with such reference signal for predetermined time.

DETAILED DESCRIPTION OF THE PREFERRED EMBODIMENT

Figure 1:
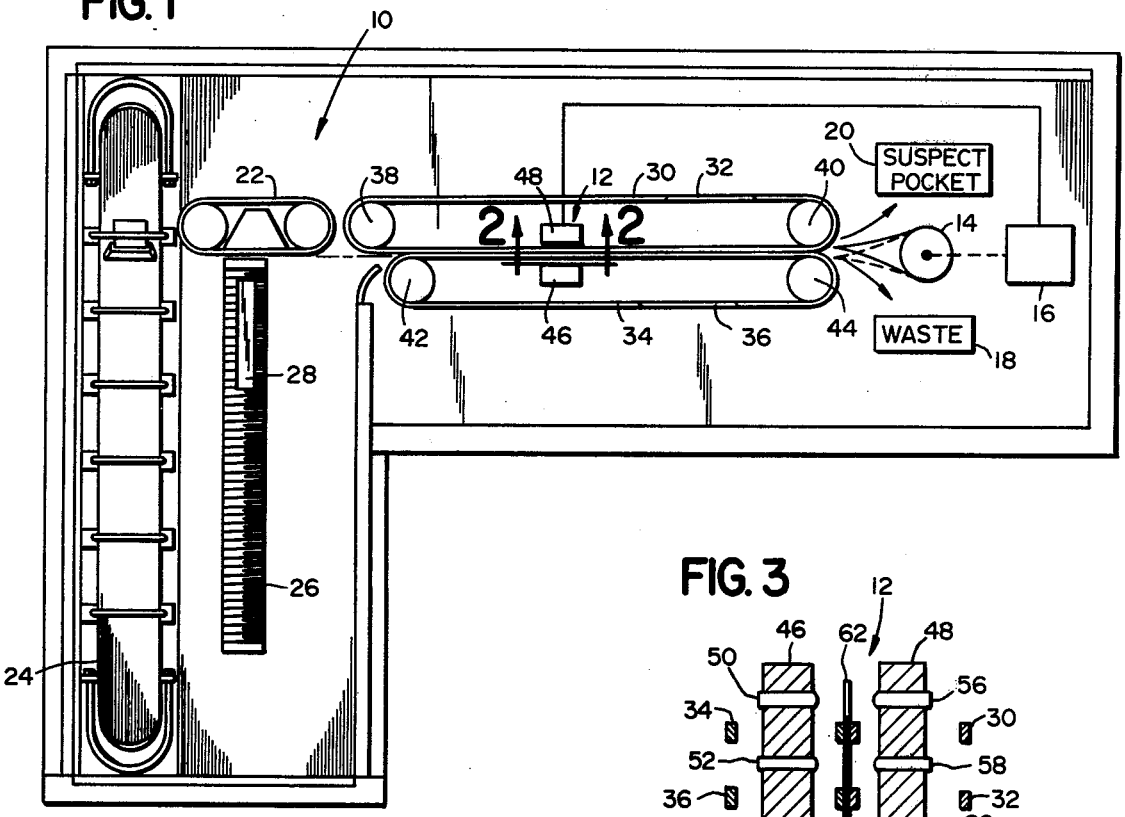
FIG. 1 is a plan view, partly diagrammatic, of an envelope handling device embodying the present invention.
Figure 3:
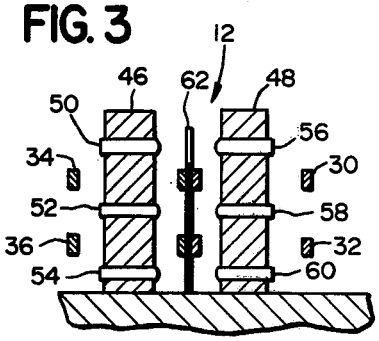
FIG. 3 is a vertical sectional view taken on the line 3—3 of FIG. 2.
Figure 2:
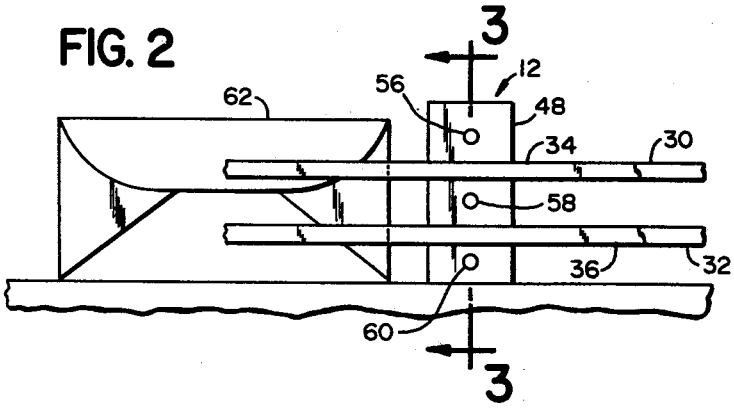
FIG. 2 is an enlarged fragmentary vertical sectional view taken on the line 2—2 of FIG. 1.

Referring to FIGS. 1, 2 and 3, an envelope handling device is there shown and, except for the opacity sensing and related signal processing electronic system, is similar to that shown in the above-mentioned pending patent application. In particular, the device comprises a feeding mechanism indicated generally at 10, for feeding a plurality of envelopes one at a time past an inspection station 12 and to a two-position gate 14 located downstream of the inspection station. The gate 14 is operable by a control system 16 responsive to the output from the inspection station 12 to condition the gate to direct an envelope moving from the inspection station to either a waste destination 18, corresponding to the solid line showing of the gate, or to a suspect pocket 20, corresponding to the broken line showing of the gate.

The device of FIG. 1 is one intended for use with generally rectangular envelopes, the feeder mechanism for moving the envelopes past the inspection station 12 being one such that each envelope is moved in the direction of the arrows with its two end edges vertical and perpendicular to the direction of movement and with its two side edges horizontal and parallel to the direction of movement, there further being a space between the trailing edge of one envelope and the leading edge of the next. Various different feeders may be used to perform the feeding function, but, preferably and as shown, the feeder 10 is similar to that of U.S. Pat. No. 3,647,203 to which reference may be had for further details of its construction.

For the present purposes, it is sufficient to note that the feeder 10 includes a continuously moving endless vacuum transfer belt 22, a traveling rack 24 and a rotating screw 26. Along a part of its length, the screw 26 has a flat 28 which, as the screw rotates, jogs the envelopes causing the contents, if any, of the envelopes to tend to move toward the lower side edges of the envelopes in which they are contained.

The vacuum belt 22 successively shifts the forwardmost envelope of the stack away from the stack, to the right in FIG. 1, and into the nip of a set of conveyor belts 30, 32, 34 and 36 which move each envelope at constant velocity past the inspection station 12 and toward the gate 14. The two belts 30 and 32, as also shown in FIG. 2, are vertically spaced from one another and are trained over two rolls 38 and 40, one of which is driven at a constant angular velocity. Likewise, the two belts 34 and 36 are vertically spaced and are trained over two rolls 42 and 44, one of which is driven at the same constant velocity as the driven one of the rolls 38 and 40.

The inspection station 12 consists of a set of three opacity sensors each consisting of a lamp or other light source, the light source and the detector being so arranged that an envelope 62 moving past the inspection station moves between the light source and the detector so that the amount of light received by the detector during such time is dependent on the opacity of the envelope and of any document contained therein. In particular, the illustrated inspection station 12, as shown in FIGS. 1, 2 and 3, has two housings or mounts 46 and 48 located respectively on opposite sides of the path of envelope travel. The mount 46 includes three lamp units 50, 52 and 54 and the mount 48 includes three photosensitive detectors in the form of photoconductive transis tors 56, 58 and 60.

The lamp unit 50 and detector 56 together comprise a "top" sensor for sensing the opacity of a small discrete field located between the lamp 50 and the detector 56 The position of this sensor field is such that as an envelope 62 moves past the inspection station, the sensed field is located a small distance inboard or downwardly of the top horizontal side edge of the envelope. Likewise, the bottom lamp 54 and its associated detector 60 form a "bottom" sensor for sensing the opacity of a small discrete field located slightly inboard or above the lower side edge of an envelope passing the inspection station. The lamp 54 and detector 58 form a "center" sensor for sensing the opacity of a small discrete field located vertically in line with the fields of the other two sensors and located approximately at the center of the width of the envelopes passing the inspection station.

Figure 4:
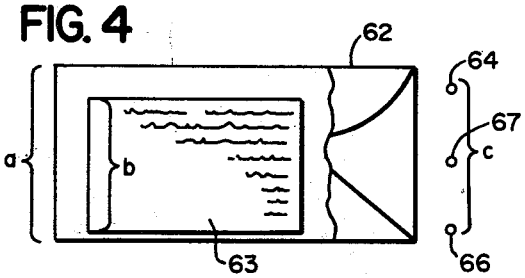
FIG. 4 is a view showing the relationship between the width of an envelope, the width of an enclosed document and the corresponding locations of the three opacity sensors.

FIG. 4 shows in more detail the arrangement and spacing of the three sensed fields of the three opacity sensors relative to an envelope 62 passing the inspection station and having an enclosed document 63. The width of the envelope is indicated at *a* and the width of the enclosed document is indicated at *b*. The field to the top sensor is indicated at 64, the field of the bottom sensor at 66 and the field of the center sensor at 67. The spacing between the top and bottom fields 64 and 66 is indicated at *c*. This spacing *c* is greater than that of the document width *b* but less than the envelope width *a*.

Thus, ignoring seams in the envelope, if an empty envelope moves past the inspection station, the three sensors will see substantially equal opacities during the full duration of the envelope's passage through the station and they will produce substantially equal output voltage signals related to the sensed opacities.

On the other hand, if an envelope containing a document 63 moves past the inspection station, one or the other of the top and bottom sensors will detect a less dense opacity than the center sensor during the time that the document passes the inspection station. That is if the document 63 is positioned near the bottom edge of the envelope, as seen in FIG. 4, the center and bottom sensors will sense more dense opacities than the top sensor as the document moves past the inspection station. If the document 63 happens to be positioned near the top edge of the envelope, then the top and center sensors will sense greater opacities than the bottom sensor as the envelope moves past the inspection station. Another possibility is that the enclosed document may have a width less than that of the illustrated document 63 and may reside in the middle of the envelope so that during passage of the envelope past the inspection station, only the center sensor detects a greater opacity due to the presence of the document. In all of these latter cases, and as hereinafter explained in more detail, the opacity signal produced by the center sensor is compared with that produced by the top and bottom sensors and differences which cause unfavorable comparisons, and which persist for predetermined times, are used to provide "suspect" signals appropriately operating the gate mechanism to divert the suspected envelopes to the suspect pocket.

Another possibility is that an enclosed document may have a width greater than that of the illustrated document 63 and be positioned in the envelope so as to intercept the fields of all three sensors as its envelope is moved past the inspection station. To accommodate this case, the output signal from one of the sensors, preferably the center sensor, is compared with a given preestablished reference signal and a suspect signal is produced if such comparison remains unfavorable for a predetermined time.

The presence of seams in an envelope passing the inspection station also causes momentary differences in the outputs of the three opacity sensors; however, these momentary differences are ignored or suppressed by requiring the unfavorable signal comparisons to appear for predetermined times, longer than that required for the passage of a typical seam past the inspection station, before a suspect signal is produced. Also, except in the case of an unusually wide document covering all three sensors, the center sensor provides a reference value which varies in unison with corresponding variations in the signals of the top and bottom sensors due to differences in the opacity of the envelope material and therefore such differences have little or no effect on the reliability of the detection system.

Figure 5:
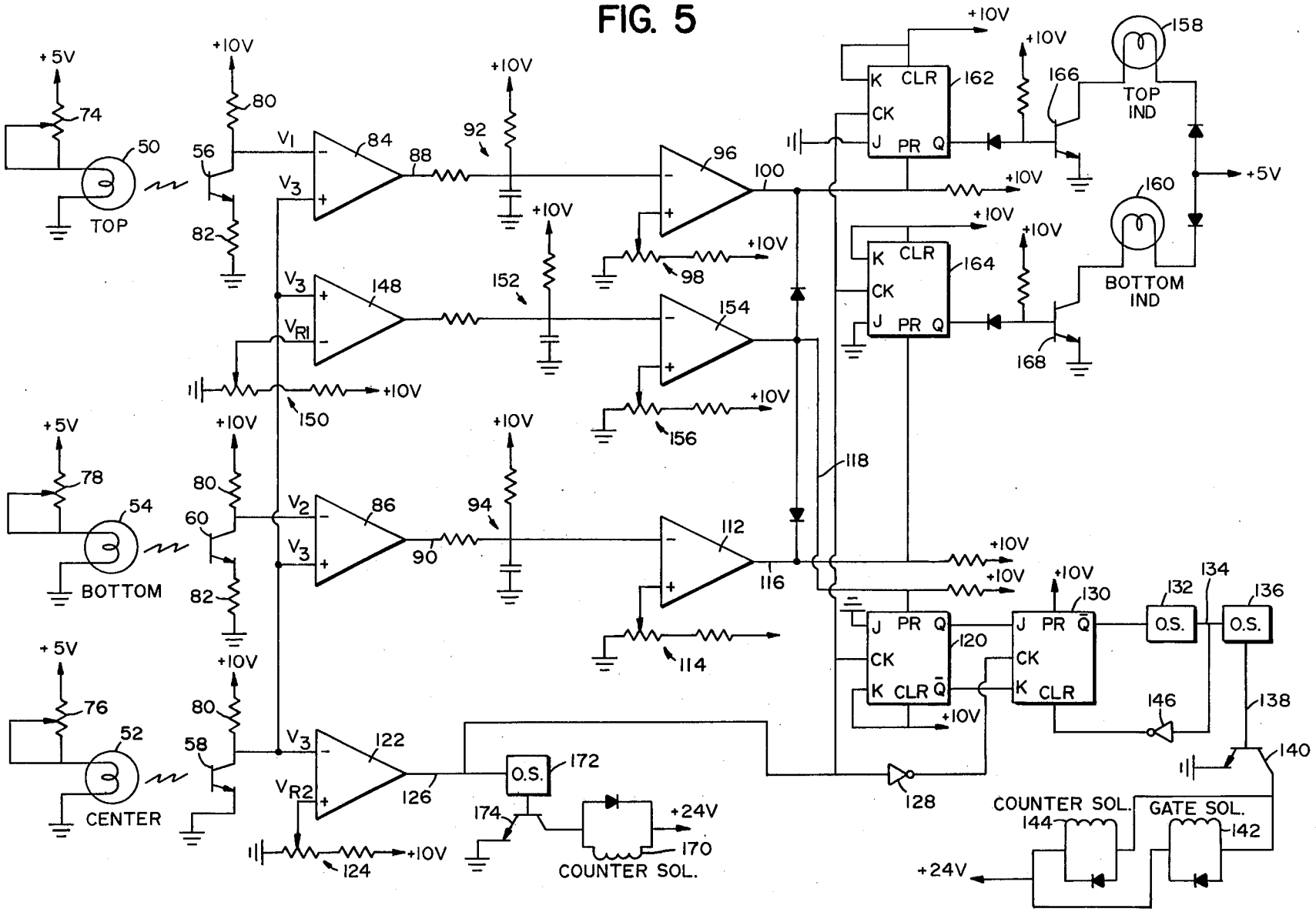
FIG. 5 is a schematic wiring diagram of a portion of the device of FIG. 1.

Referring to FIG. 5, this figure shows the wiring diagram of the electrical control system associated with the inspection station 12 and gate mechanism 14. The three lamps 50, 52 and 54 are energized through three manually adjustable potentiometers 74, 76 and 78, respectively, whereby the intensity of the light emitted from each lamp may be varied in setting up and calibrating the device. The three photoconductive transistors 56, 58 and 60 are each energized from a positive ten volt source through similar voltage dropping resistors 80, 80. The two transistors 56 and 60 have their emitters connected to ground through similar resistors 82, 82 whereas the center transistor 58 has its emitter connected directly to ground, the resistors 82, 82 being of relatively low resistance compared to the resistors 80, 80. The collector voltages $V_1$, $V_2$ and $V_3$ therefore vary inversely with the opacity of their sensed fields. That is, as the opacities of the three sensed fields become greater (more dense), the voltage signals $V_1$, $V_2$ and $V_3$ decrease. For equal sensed opacities, however, the center transistor 58 is biased, by the lack of a resistor in its emitter to ground circuit, to have a slightly lower value for its output voltage $V_3$ than the values of the output voltages $V_1$ and $V_2$. The voltage $V_3$ is compared with the voltages $V_1$ and $V_2$ by operational amplifiers 84 and 86. The amplifier 84 compares $V_1$ with $V_3$ and produces a non-compare output signal of fixed voltage on the line 88 when the voltage $V_3$ exceeds the voltage $V_1$ (indicating that the top sensor sees a less dense field than the center sensor). Likewise, the amplifier 86 produces a non-compare output signal of fixed voltage on the line 90 when $V_3$ is substantially greater than $V_2$ (indicating that the bottom sensor sees a substantially less dense field than the center sensor).

The non-compare signal, if any, appearing on the line 88 is integrated by an integrating circuit 92 and the integrated signal so produced is supplied to an amplifier 96 which compares it with a predetermined reference voltage from the circuit 98. When the integrated signal reaches the value established by the circuit 98, which in turn requires the non-compare signal to exist for a predetermined amount of time, the amplifier 96 produces a suspect signal in the form of a low voltage on the line 100. Likewise, the integrated signal provided by the integrating circuit 94 is supplied to an amplifier 112 which compares it with a predetermined reference voltage from the associated circuit 114, and when the integrated signal reaches the reference value, the amplifier produces a suspect signal in the form of a low voltage on the line 116. When a suspect signal appears on either the line 100 or the line 116, it sets, through the line 118, a suspect signal flip-flop or register 120 for temporary storage of the suspect signal.

The output signal from one of the three photoconductive transistors 56, 58 and 60 is also supplied to an amplifier 122 and compared with a reference voltage $V_{R2}$ supplied by an associated circuit 124 to provide leading and trailing edge signals on the line 126 indicating the passage of envelopes through the inspection station. In the illustrated case of FIG. 5, the center transistor 58 is chosen for this purpose and has its output voltage $V_3$ supplied to the amplifier 122. The circuit 124 is set so the voltage $V_{R2}$ represents an opacity less dense than that of the least opaque envelope likely to be encountered. Therefore, as soon as the leading edge of an envelope enters the inspection station, $V_3$ shifts from a positive voltage less than $V_{R2}$ to a positive voltage greater than $V_{R2}$ to create the negative going edge of a low voltage pulse on the line 126. When the trailing edge of the envelope leaves the inspection station, $V_3$ again becomes greater than $V_{R2}$ and the low pulse is terminated by a positive going edge. The negative going edge of the pulse therefore is a leading edge signal indicating the entry of the leading edge of an envelope into the inspection station and the positive going edge is a trailing edge signal indicating the departure of the trailing edge of the envelope from the inspection station.

The leading and trailing edge signals are applied to the clock terminal of the suspect register 120 as well as to the clock terminals of the registers 162 and 164 hereinafter described. At the occurrence of each negative going leading edge signal, the suspect signal register 120 also has a high signal supplied to its preset terminal by the line 118 and therefore the register 120 is set with its Q output low and its Q output high. If a suspect signal appears on the line 118 before the next occurring trailing edge signal, such signal drives the preset terminal low to change Q to high and Q to low, thus indicating the storage of the suspect signal. When the trailing edge signal next arrives, it through the inverter 128 clocks an associated register 130 causing its output Q to go low if the register 120 at that time stores a suspect signal.

When the Q output of the register 130 goes low, it triggers a first one-shot multivibrator 132 producing a pulse having a prescribed interval on line 134. The trailing edge of this pulse in turn triggers a second one-shot multivibrator 136 which produces another pulse of prescribed interval on the line 138. The pulse produced by the multivibrator 136 on the line 138 is positive and turns on a transistor 140 during its appearance to energize a gate solenoid 142 and a counter solenoid 144.

The energization of the gate solenoid 142 drives the gate 14 to the broken line position of FIG. 1 to divert an envelope encountering it to the suspect pocket 20, and the counter solenoid 144 when operated advances a related counter to keep count of the total number of envelopes diverted to the suspect pocket. The duration of the pulse provided by the first multivibrator 132 is approximately equal to the amount of time required for an envelope to move from the inspection station to the gate, and the duration of the pulse provided by the second multivibrator 136 is approximately equal to that required for an envelope to pass through the gate. Accordingly, it will be understood that when a suspect signal is produced as a result of an envelope passing the inspection station, that envelope when it reaches the gate 14 will find the gate positioned to divert it to the suspect pocket. On the other hand, when no suspect signal is produced the gate 14 remains in the solid line position of FIG. 1 and therefore as the associated envelope passes the gate it diverts the envelope to the waste destination 18.

The trailing edge of the pulse produced by the first multivibrator 132 is also used to clear the flip-flop 130 through an inverter 146.

From the description of the system as so far made, it will be understood that in the usual case an envelope containing a document in passing the inspection station will have the document intercept the field of the center sensor but not the field of the top or bottom sensor, and the difference in the output signal from the center sensor and from one or the other of the top or bottom sensors is used to generate a suspect signal. In some unusual cases, the document contained in an envelope may be exceptionally wide and intercept the fields of all three sensors as it passes the inspection station. In this case, therefore, differences in the output signals of the three sensors cannot be used to produce a suspect signal. To provide for detection of extra wide documents, the illustrated system of FIG. 5 includes an additional amplifier 148 which compares the output signal $V_3$ from the center photoconductive transistor 58 with a reference voltage $V_{R1}$ provided by the illustrated circuit 150. The voltage $V_{R1}$ is set to represent an opacity somewhat greater (more dense) than that of the most opaque envelopes expected to be processed by the device. Therefore, when $V_3$ indicates a still greater opacity, as when a document containing envelope passes the inspection station, a non-compare output signal is produced at the output of the amplifier 148. This non-compare signal is integrated by the illustrated circuit 152 and the integrated signal is supplied to another amplifier 154 where it is compared with a reference voltage provided by a circuit 156. The amplifier 154 in turn produces a suspect signal on the line 118 when the integrated signal reaches the value of the reference voltage. This suspect signal is then treated in the same way as the previously described suspect signal produced by either the amplifier 96 or amplifier 112.

The suspect signal produced by the amplifiers 96 and 112 may also, as shown in FIG. 5, be used to drive top and bottom indicator lamps 158 and 160, respectively, for use in calibrating the device. In particular, the output of the amplifier 96 is connected to the preset terminal of a flip-flop or register 162 and the output of the amplifier 112 is supplied to the preset terminal of another flip-flop or register 164, both the registers 162 and 164 being clocked by pulses produced by the amplifier 122 and each having its Q output terminal controlling the associated indicator lamp through a transistor 166 or 168. From inspection of FIG. 5 it will therefore be understood that when a suspect signal is produced by the amplifier 96, it will cause illumination of the top indicator lamp 158 and when a suspect signal is produced by the bottom amplifier 112 it will cause illumination of the bottom indicator lamp 160.

As also shown in FIG. 5, another counter solenoid 170 is energized by the pulse from the amplifier 122 through a one-shot multivibrator 172 and transistor 174, the solenoid 170 being part of a counter for counting the total number of envelopes processed by the device.

We claim:

1. In a device for checking a plurality of generally rectangular envelopes for enclosed documents, the combination comprising: means for feeding said envelopes one at a time past an inspection station at a substantially constant velocity with each of said envelopes being oriented so that two of its edges are leading and trailing edges, respectively, both perpendicular to its direction of movement and its remaining two edges are parallel to said direction of movement, and a detection means at said inspection station, said detection means comprising first, second and third opacity sensors spaced from one another along a line generally parallel to the plane of said envelopes and perpendicular to said direction of envelope movement and each producing an electrical output signal which varies with the opacity of an associated discrete sensed field, said three opacity sensors being arranged so that as said envelopes are moved past said inspection station the field sensed by said first sensor is located inboard of one of said two remaining edges of each envelope, said field sensed by said second sensor is located inboard of the other of said remaining edges of each envelope, and said field sensed by said third sensor is located between said fields of said first and second sensors, and suspect signal producing means responsive to the existence for a predetermined time of a substantial difference in the values of the output signals of said first and third opacity sensors or of the output signals of said second and third opacity sensors for producing a suspect signal indicating the suspected presence of a document in the envelope producing such suspect signal.

2. The combination defined in claim 1 further characterized by said predetermined time being greater than that required for an envelope to travel one half inch at said constant velocity.

3. The combination defined in claim 1 further characterized by said predetermined time being that required for an envelope to travel between two to three inches at said constant velocity.

4. The combination defined in claim 1 further characterized by an envelope indicating means connected to receive the electrical output signal from one of said three opacity sensors and for producing in response of such received signal leading edge and trailing edge electrical signals indicative respectively of the passage of leading and trailing edges of said envelopes past said inspection station, a mechanical gate mechanism downstream of said inspection station alternately conditionable to direct an envelope to one or the other of two destinations, and a logic and delay circuit for controlling said gate mechanism in response to suspect signals such as the one aforesaid and to said leading edge and trailing edge signals produced by said envelope indicating means for controlling said gate mechanism in such a manner as to condition it to direct any envelope for which a suspect signal is produced to said one destination and to direct any envelope for which no suspect signal is produced to said other destination.

5. The combination defined in claim 4 further characterized by said envelope indicating means being connected to said third opacity sensor so as to receive the output signal produced by said third opacity sensor.

6. The combination defined in claim 1 further characterized by each of said three opacity sensors consisting of a photoelectric cell and a light source for directing light rays toward said photoelectric cell, said photoelectric cell and said light source being located on opposite sides of the path of movement of said envelopes.

7. The combination defined in claim 1 further characterized by said three opacity sensors being such that said electrical output signals produced thereby are voltage signals having voltage levels analogously related to the opacities of said sensed fields, means producing a reference voltage signal, and said suspect signal producing means also including means for producing a suspect signal in the event the voltage level of said output signal from said third opacity sensor exceeds that of said reference voltage signal for a predetermined time.

8. The combination defined in claim 1 further characterized by an envelope indicating means connected to receive the electrical output signal from one of said three opacity sensors and for producing in response to such received signal leading edge and trailing edge signals indicative respectively of the passage of leading and trailing edges of said envelopes past said inspection station, a register for storing a suspect signal produced by said suspect signal producing means during the passage of an envelope past said inspection, a gate mechanism located downstream of the path or envelope travel from said inspection, means responsive to the occurrence of one of said trailing edge signals while said register stores no suspect signal for conditioning said gate mechanism to direct the envelope causing said one trailing edge signal to a first destination and responsive to the occurrence of one of said trailing edge signals while said register stores a suspect signal for conditioning said gate mechanism to direct the envelope causing said one trailing edge signal to a second destination, and means for clearing said suspect signal register in response to one of the leading edge and trailing edge signals resulting from the passage of each of said envelopes past said inspection station.

9. The combination defined in claim 8 further characterized by said means for clearing said suspect signal register being operable to clear said suspect signal register in response to each of the leading edge signals produced by said envelope indicating means.

10. The combination defined in claim 1 further characterized by said first, second and third opacity sensors producing electrical output voltage signals $V_1$, $V_2$ and $V_3$, respectively, each of which signals is related to the opacity of its associated sensed field, means for comparing $V_1$ and $V_3$ and for producing a first non-compare signal of fixed voltage when $V_3$ represents a greater sensed opacity than $V_1$, means for comparing $V_2$ and $V_3$ and for producing a second non-compare signal of fixed voltage when $V_3$ represents a greater sensed opacity than $V_2$, means for integrating said first non-compare signal and for producing a suspect signal when the integrated signal thereby produced reaches a predetermined value, and means for integrating said second non-compare signal and for producing a suspect signal when the integrated signal thereby produced reaches a predetermined value.

11. The combination defined in claim 10 further characterized by means producing a reference voltage signal $V_R$, means for comparing $V_R$ and $V_3$ and for producing a third non-compare signal when $V_3$ represents a greater sensed opacity than $V_R$, and means for integrating said third non-compare signal and for producing a suspect signal when the integrated signal thereby produced reaches a predetermined value.

12. The combination defined in claim 11 further characterized by said predetermining values being such that any one of said non-compare signals need be present for a time duration equal to at least one half inch of movement of an envelope at said constant velocity for the related integrated signal to reach its associated predetermined value.

* * * * *